US010689930B2

(12) United States Patent
Crabb et al.

(10) Patent No.: US 10,689,930 B2
(45) Date of Patent: Jun. 23, 2020

(54) DUAL-ACTION HYDRAULICALLY OPERABLE ANCHOR AND METHODS OF OPERATION AND MANUFACTURE FOR WELLBORE EXIT MILLING

(71) Applicant: WILDCAT OIL TOOLS, LLC, Midland, TX (US)

(72) Inventors: John Lloyd Crabb, Bastrop, TX (US); Charles H. Dewey, Houston, TX (US); Antonio Garza, Tomball, TX (US)

( * ) Notice: Subject to any disclaimer, the term of this patent is extended or adjusted under 35 U.S.C. 154(b) by 0 days.

(21) Appl. No.: 16/509,461

(22) Filed: Jul. 11, 2019

(65) Prior Publication Data

US 2019/0330944 A1 Oct. 31, 2019

Related U.S. Application Data

(63) Continuation-in-part of application No. 16/503,444, filed on Jul. 3, 2019, and a continuation-in-part of application No. PCT/US2018/025908, filed on Apr. 3, 2018.

(60) Provisional application No. 62/696,423, filed on Jul. 11, 2018.

(51) Int. Cl.

| | |
|---|---|
| ***E21B 23/01*** | (2006.01) |
| ***E21B 7/06*** | (2006.01) |
| ***E21B 29/06*** | (2006.01) |

(52) U.S. Cl.

CPC ..... *E21B 23/01* (2013.01); *E21B 7/061* (2013.01); *E21B 29/06* (2013.01)

(58) Field of Classification Search

CPC ..... E21B 23/01; E21B 23/00; E21B 23/02; E21B 7/061; E21B 29/06; E21B 21/103; E21B 33/1295; E21B 33/129

See application file for complete search history.

(56) References Cited

U.S. PATENT DOCUMENTS

| | | | | |
|---|---|---|---|---|
| 3,136,364 | A * | 6/1964 | Myers | E21B 33/1295 166/120 |
| 5,035,292 | A | 7/1991 | Bailey | |
| 5,443,129 | A | 8/1995 | Bailey | |
| 5,771,972 | A | 6/1998 | Dewey | |
| 5,829,518 | A | 11/1998 | Gano et al. | |

(Continued)

OTHER PUBLICATIONS

International Search Report dated Jul. 10, 2018 from International Application No. PCT/US2018/025908.

*Primary Examiner* — George S Gray

(74) *Attorney, Agent, or Firm* — Hulsey P.C.

(57) ABSTRACT

A dual-action hydraulically operable anchor includes a hydraulic anchor body for positioning a whipstock in a wellbore. A split clamp retains an upper sub and the hydraulic anchor body. A lower cap guides the hydraulic anchor within the wellbore. The floating mandrel transmits a hydraulic fluid into the fixed housing, transmitting compressive force from the upper hydraulic piston or from mechanical force applied to the whipstock above and adjoining the hydraulic anchor. The lower hydraulic piston operates along the floating mandrel using transmitted hydraulic fluid. A T-slot adapter and a slip move from a flush position along the fixed housing to an extended position along the fixed housing such that the slip firmly engages the wellbore to hold the hydraulic anchor and the whipstock in a fixed position for providing a path for lateral drilling outside the wellbore.

20 Claims, 8 Drawing Sheets

(56) References Cited

U.S. PATENT DOCUMENTS

| | | | | |
|---|---|---|---|---|
| 5,829,531 | A | 11/1998 | Hebert | |
| 6,102,123 | A | 8/2000 | Bailey | |
| 6,648,068 | B2 | 11/2003 | Dewey | |
| 7,377,328 | B2 | 5/2008 | Dewey et al. | |
| 8,122,977 | B2 | 2/2012 | Dewey | |
| 8,459,357 | B2 | 6/2013 | Dewey | |
| 8,919,431 | B2 | 12/2014 | Lott | |
| 8,997,895 | B2 | 4/2015 | Swadi et al. | |
| 2006/0037759 | A1 | 2/2006 | Braddick | |
| 2008/0093076 | A1 | 4/2008 | Patil | |
| 2009/0101362 | A1* | 4/2009 | Loughlin | E21B 23/01 166/382 |
| 2009/0140112 | A1 | 6/2009 | Carnevali | |
| 2010/0276145 | A1 | 11/2010 | Dewey | |
| 2012/0222902 | A1 | 9/2012 | Alsup | |
| 2013/0213654 | A1* | 8/2013 | Dewey | E21B 7/061 166/285 |
| 2013/0299160 | A1* | 11/2013 | Lott | E21B 23/01 166/88.2 |
| 2015/0226010 | A1 | 8/2015 | Drews | |
| 2015/0345241 | A1 | 12/2015 | Glaser et al. | |
| 2016/0053559 | A1* | 2/2016 | Alley | E21B 23/01 166/212 |
| 2016/0076327 | A1 | 3/2016 | Glaser et al. | |
| 2017/0101840 | A1 | 4/2017 | Kauffmann et al. | |

* cited by examiner

DUAL-ACTION HYDRAULICALLY OPERABLE ANCHOR AND METHODS OF OPERATION AND MANUFACTURE FOR WELLBORE EXIT MILLING

CROSS REFERENCE TO RELATED APPLICATIONS

This application claims the benefit of the following patent applications:

- U.S. Provisional Patent Application 62/696,423 entitled "Dual-Action Hydraulically Operable Anchor," filed on Jul. 11, 2018, which is here expressly incorporated by reference;
- U.S. Provisional Patent Application 62/696,750 entitled "Dual-Action Hydraulically Operable Anchor," filed on Jul. 11, 2018, which is here expressly incorporated by reference;
- U.S. Provisional Patent Application 62/693,873 entitled "Bi-Mill For Milling An Opening Through A Wellbore Casing In Initiating With Helical Debris Channels And Dense Milling Inserts Configuration," filed on Jul. 3, 2018, which is here expressly incorporated by reference; and
- U.S. Non-Provisional patent application Ser. No. 16/503,444 entitled "A Bi-Mill For Milling An Opening Through A Wellbore Casing And In A Preplanned Lateral Drilling Path In Departure From The Wellbore Axis," filed on Jul. 3, 2019, which is here expressly incorporated by reference.

FIELD OF THE DISCLOSURE

The present disclosure relates generally to oilfield drilling equipment and more particularly to expandable anchoring tools for use in drilling operations, and methods of attaching an expandable anchor to a wellbore wall. Further, the present invention relates to methods and apparatus for drilling a secondary borehole from an existing borehole in geologic formations. More particularly, the present invention relates to making and using expandable anchors that can be run into boreholes of varying diameters and then expanded to set against either a cased or open hole to anchor another well tool for conducting downhole well operations.

BACKGROUND OF THE DISCLOSURE

Downhole anchoring tools include a wellbore anchor for use in firmly fixing a whipstock and similar equipment in the wellbore during sidetracking or lateral drilling operations, also known as "wellbore departure" operations. Here, wellbore anchoring systems may be used to anchor drilling equipment downhole in order to permit certain wellbore operations. Once a main wellbore has been drilled, it is often necessary or desired to drill one or more additional boreholes that branch off, or deviate, from the main wellbore. Such lateral boreholes are typically directed toward different parts of the surrounding formation, with the intent of increasing the output of the well. The main wellbore can be vertical, angled or horizontal. Wellbore departure technology can be applied to both new and existing wells.

In order to drill a new borehole that extends outside an existing wellbore, the usual practice is to use a work string to run and set a whipstock via an anchor disposed at the lower end thereof. The upper end of the whipstock comprises an inclined face. The inclined face is designed to guide a window milling bit(s) radially outwardly with respect to the main wellbore axis as the milling bit is lowered, so that the milling bit creates an opening in the main wellbore and into adjacent formation rock. The main wellbore may have casing cemented in place or be without casing, known in the art as "open hole." The lower end of the whipstock is connected, directly or indirectly, to an anchor so that when the anchor is locked in the wellbore it prevents both axial and rotational movement of the whipstock.

Wellbore departure technology provides operators several benefits and economic advantages. For example, wellbore departure and lateral drilling operations can access isolated pockets of hydrocarbons which might otherwise be left in the ground. In addition, lateral drilling technology improves reservoir drainage, increasing the volume of recoverable reserves and enhancing the economics of marginal pay zones. Anchors are a key component of wellbore departure operations.

Some disadvantages of known wellbore anchors include limited radial expansion capabilities and limited force for securing the anchor against the wellbore wall, especially in larger diameter wellbores. As such, prior art expandable anchors that support whipstocks for drilling sidetrack boreholes, for example, may be susceptible to small, but not insignificant amounts of movement. Hence, it would be desirable to provide an expandable anchor that effectively prevents an anchored whipstock from moving.

Examples of such systems include U.S. Pat. No. 7,377,328, entitled "Wellbore Anchoring System" shows an expandable downhole anchoring tool positionable within a wellbore for use in cooperation with drilling equipment. That system includes a body having a plurality of angled channels formed into a wall thereof, and a plurality of moveable slips disposed in the same radial plane around the body. There, the plurality of moveable slips are hydraulically translatable along the plurality of angled channels between a collapsed position and an expanded position. The disclosure further encompasses a method of setting an expandable anchor within a wellbore and includes running the anchor into the wellbore in a collapsed position. Then, expanding the anchor into gripping engagement with the wellbore, the anchor adapts to expand up to at least 1.5 times a collapsed diameter of the anchor.

U.S. Pat. No. 8,919,431, also entitled "Wellbore Anchoring System" shows a hydraulic wellbore anchoring system for use with whipstocks or other tools in either cased or open hole wellbores. The anchoring system includes an upper slip system and a lower slip system. The anchor system may be set using hydraulic pressure and withdrawn by a predetermined upward force. While the slips of the upper and lower slip systems may be set substantially simultaneously, the anchoring system enables sequential disengagement of the slips to reduce the force required for withdrawal.

With the anchoring systems referenced above certain limitations exist. First of all, a limitation relates to the susceptibility to shocks that frequently occur as the anchor system traverses down the wellbore. Contact with an uneven wellbore, debris, and other irregular or unexpected interferences may arise as the anchor trips into the wellbore. In some situations, slips and inserts may contact these interferences during the trip into the wellbore and sustain damage. Damage to these components can adversely affect the performance of an anchor system, including anchor placement and stability in the wellbore. The unfortunate result may be an anchor system that is improperly positioned or insecurely placed. This could jeopardize the entire wellbore departure operation and result in significant losses in terms of non-productive time and monetary capital.

Another limitation with existing anchor systems is relatively weak setting force. Many known anchors employ a single means of applying setting force. Some known hydraulic anchors may have means for applying two different types of setting force, but may do so in sequence, not applying these forces concurrently. The ability to apply additive force, such as means of applying three or more types of setting force, is not seen in the prior art. The failure to use additive setting forces results in a less than secure anchor that sets with less certainty in the wellbore.

In light of these considerations and others, which are here addressed, there is the need for an improved dual-action hydraulically operable anchor system and methods of operation and manufacture as here described and claimed.

BRIEF SUMMARY OF THE DISCLOSURE

The present disclosure details a method, system, and fabrication method for a hydraulic anchor for use in securing a whipstock in position so that a wellbore departure or wellbore exit milling operation may commence. In this exit milling operation, an opening through a wellbore wall is created and a bore is formed over a short distance in adjacent rock formation. The hydraulic anchor is essential in this process as it secures the whipstock in place so that the whipstock resists torsional and compressive forces that may be applied during exit milling and subsequent drilling operations.

According to one aspect of the present disclosure, there is here provided a dual-action hydraulically operable anchor and methods of operation and manufacture for wellbore exit milling. The dual-action hydraulic anchor includes a hydraulic anchor body, and an upper hydraulic piston and an opposing lower hydraulic piston. The upper hydraulic piston and the lower hydraulic piston force slips outward to fixedly position, or "set," the anchor in a wellbore. The anchor, when set, secures the whipstock and makes possible wellbore departure milling and guiding lateral drilling outside the wellbore.

The hydraulic anchor further includes an upper sub for slidably engaging and containing a floating mandrel, as well as a hydraulic upper piston that threadably attaches to the floating mandrel. A split clamp flexibly retains the upper sub and fixedly attaches to the hydraulic anchor body. The split clamp permits confined movement of the upper sub toward and hydraulic anchor body toward and away from each other. A lower cap fixedly couples to the hydraulic anchor body and includes a guide nose for guiding the hydraulic anchor within the wellbore and containing a threaded plug to hydraulically seal the the hydraulic anchor body.

A floating mandrel within the hydraulic anchor body includes an upper piston threadably attached at the floating mandrel's upper end and slidably moving within the upper sub and along the longitudinal axis of the fixed housing. A hydraulic lower piston with locking ratchet nut, upon anchor actuation, travels upward along the floating mandrel and applies a first force to move slips outward from the anchor body.

Additionally, following the hydraulic lower piston's upward travel, the hydraulic upper piston applies compressive force to drive the floating mandrel downward to advance in opposition to the movement of the hydraulic lower piston and locking ratchet nut. Additionally further, the floating mandrel transmits additional downward compressive force deriving from mechanical force applied from a surface rig to the workstring and BHA components uphole and adjoining the hydraulic anchor.

The hydraulic lower piston is located below the hydraulic upper piston and operates from a first position to a second position along the floating mandrel using transmitted hydraulic fluid. A T-slot adapter engages the hydraulic lower piston. A slip engages the T-slot adapter and may slide within the fixed housing from a flush position along the fixed housing to an extended position along the fixed housing in response to movement of the T-slot adapter and the lower piston within the fixed housing. In response, the slip firmly engages the wellbore to hold the hydraulic anchor and the whipstock in a fixed position within the wellbore, thereby providing a path for lateral drilling outside the wellbore. A threaded locking ratchet nut attaches to the lower hydraulic piston and slidably moves along a threaded portion of the floating mandrel. The locking ratchet nut mechanically locks the lower hydraulic piston in a second position, with the slips being retained mechanically in the extended position engaging the wellbore wall.

In another aspect of the present disclosure, here are disclosed methods, devices, and systems to provide a hydraulic anchor having opposing upper and lower hydraulic pistons for extending slips outward with considerable force in order to fixedly position a whipstock in a wellbore. The whipstock enables wellbore exit milling and initial guiding of lateral drilling outside the wellbore. The hydraulic anchor includes an upper sub for loosely retaining a floating mandrel attached to a hydraulic upper piston. The upper sub houses the hydraulic upper piston to hydraulically engage and advance the floating mandrel with supplied hydraulic force, advancing the mandrel downward.

A Belleville spring stack abuts the lower external face of the upper sub, forcing the upper sub, upward to the point where it is retained by the inner face of the upper portion of a split clamp assembly in the absence of hydraulic or mechanical compressive force. The upper sub's housed hydraulic upper piston, attached to the upper end of the floating mandrel, is retained at the upper end of the upper sub by a threaded male connection end of a hinged connector or similar adjacent sub. The split clamp assembly loosely and slidably retains the upper sub to the hydraulic anchor body. A lower cap fixedly couples to the body and comprises a guide nose for guiding the hydraulic anchor within the wellbore, smoothing its travel around minor obstructions or uneven portions of the wellbore, with the lower cap and the hydraulic anchor body threadably connected, and the lower cap's central bore being closed with a plug, or open, depending on operational parameters. A floating mandrel extends from inside the upper sub to inside the lower cap with slidably moveable axial engagement of a locking ratchet nut within the hydraulic anchor housing.

Inside the floating mandrel, along its longitudinal axis, a flow of hydraulic fluid originating from a piston inside a running tool travels through the floating mandrel to actuate the lower piston disposed in the anchor body, forcing the mandrel upward and advancing the slips. A hydraulic lower piston located below the upper piston at the end of the floating mandrel distal from the upper piston actuates from a first position to a second position along the floating mandrel using hydraulic fluid supplied through the inner axial bore of the floating mandrel. This lower piston actuation forces the slips outward from the anchor body and concurrently advances a locking ratchet nut along a threaded portion of the floating mandrel. Additionally, the floating mandrel receives compressive force from the upper piston housed in the upper sub when hydraulic force is applied to the upper piston, forcing it downward against the floating mandrel and serving to advance the mandrel slidably against the locking ratchet nut, further increasing setting force.

As needed, the floating mandrel can receive a third force in the form of compressive force from mechanical force applied to the work string above and adjacent upstream BHA adjoining the hydraulic anchor, providing yet more force to advance the mandrel slidably against the locking ratchet nut. The two hydraulic forces and the mechanical force can be applied concurrently, making the three forces additive, and thereby setting the anchor with extreme force. At the upper, uphole end of the lower piston, a T-slot adapter engages the mandrel piston on the lower, downhole side of the T-slot adapter. A slip slidably engages the T-slot adapter on the upper side of the T-slot adapter within the anchor housing. With standard-sized slips, the slips advance from a first flush-with-anchor housing position through an opening in the anchor housing to a second, extended position extending outward from the anchor housing in response to movement of the T-slot adapter slidably engaged with the lower piston within the anchor housing.

Upon reaching its extended position, the slip firmly engages the wellbore to hold the hydraulic anchor and adjoining BHA components, including the whipstock, in a fixed position. A threaded locking ratchet nut attaches to the hydraulic piston and is slidably moveable along a lower, threaded portion of the floating mandrel, with locking ratchet nut engaging the threaded portion of the mandrel and mechanically locking the hydraulic piston in its second position, with the slips being retained mechanically, after hydraulic actuation has ceased, in the extended position engaging the wellbore wall. With the anchor fixedly secured against the wellbore casing or rock formation wall, a wellbore departure operation can be executed, subsequently providing a path for lateral drilling outside the main wellbore.

A technical advantage of the presently disclosed dual-action hydraulically operable anchor system includes an improved system that frictionally engages the inner wellbore wall with extreme force, cased or openhole as the case may be, with slidable slips moving outward from the anchor body to contact the wellbore wall once the anchoring tool reaches the desired depth and circumferential orientation.

A technical advantage of the presently disclosed dual-action hydraulically operable anchor system includes an improved system that frictionally engages the wellbore by delivering additive setting force in multiple ways. The subject matter of this disclosure applies three different setting forces, including two with opposing hydraulic cylinders and an additional compressive mechanical force from the workstring, if desired. The two opposing hydraulic cylinders allow the anchor to set with greater hydraulic force, when utilizing only hydraulic force, than prior art hydraulic anchors. The multiple means of applying force to set the anchor is also an improvement upon prior art anchors.

Another object of this disclosure is to absorb shocks that the anchor might experience while tripping downhole. This hydraulic anchor has a stack of Belleville springs that abut the lower end of its upper sub, with the upper sub being attached to the BHA/workstring. The Belleville springs keep the upper sub and anchor body spread apart under normal, static conditions, with the split clamps retaining the upper sub and body together. If the anchor experiences shocks as it travels downhole due to an uneven bore, debris, or other issues, the Belleville springs provide a cushioning effect that will help the anchor absorb shocks. The ability to absorb shocks can prevent damage to slips or insert buttons in the slips, and represents a departure from the prior art.

These and other objects of the present invention are achieved through a provision of a wellbore anchor tool, which comprises an anchor body, an elongated hollow mandrel disposed axially within the anchor body, an upper sub loosely engaged with the body and retained by a split clamp assembly, a Belleville spring stack compressed against the upper sub, a plurality of frictional members ("slips") members positioned within the anchor body for slidable outward movement to frictionally engage an inner wellbore wall, a lower piston hydraulically actuated to advance the slips, an upper piston opposing the lower piston and hydraulically actuated to advance the mandrel, and a locking ratchet nut that slidably advances along the mandrel during lower piston and upper piston actuation with locking ratchet nut maintaining its position following application of opposing hydraulic forces.

Still further objects, technical aspects and advantages of the presently disclosed subject matter will become evident upon a full appreciation of the following specification, drawings, and claims.

BRIEF DESCRIPTION OF THE DRAWINGS

The present subject matter will now be described in detail with reference to the drawings, which are provided as illustrative examples of the subject matter so as to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

Figure 1:
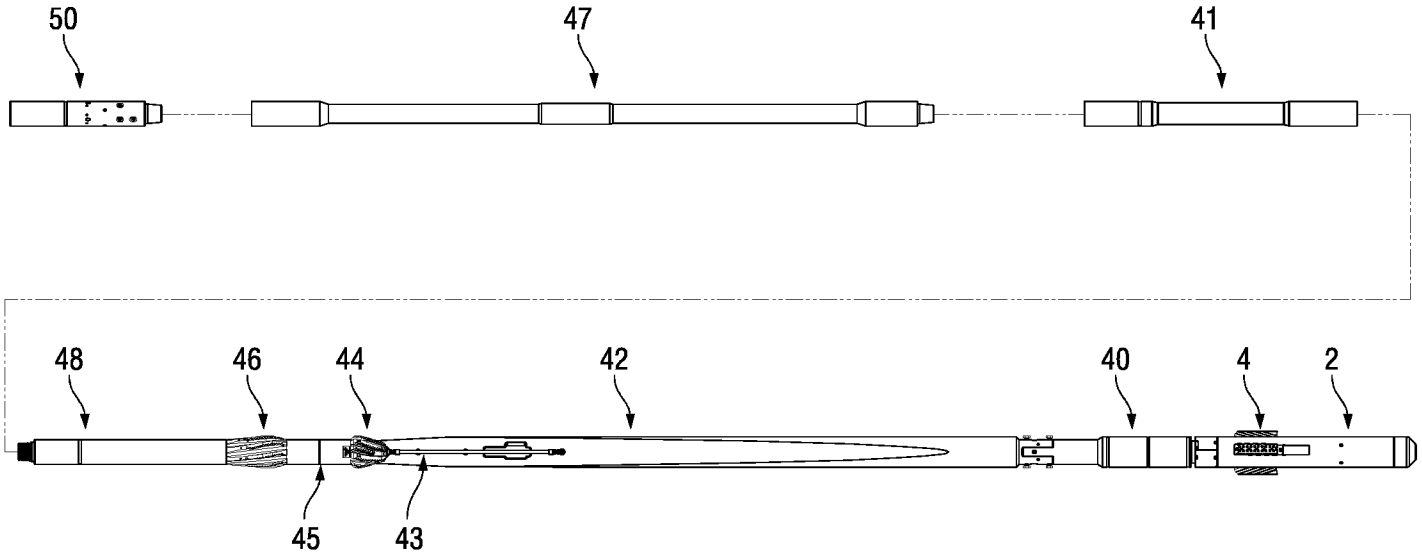
FIG. 1 depicts the bottom hole assembly (BHA) as it could be deployed in a wellbore departure operation.

Various embodiments of the expandable anchor and methods of use will now be described with reference to the accompanying drawings, wherein like reference numerals are used for like features throughout the several views. The detailed description set forth below in connection with the appended drawings is intended as a description of exemplary embodiments in which the presently disclosed subject matter can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed subject matter may be practiced without these specific details. In some instances, well-known structures and devices are shown in functional or conceptual diagram form in order to avoid obscuring the concepts of the presently disclosed method and system.

Certain terms are used throughout the following description and claims to refer to particular assembly components. This document does not intend to distinguish between components that differ in name but not function. In the following discussion and in the claims, the terms "including" and "comprising" are used in an open-ended fashion, and thus should be interpreted to mean "including, but not limited to . . . ".

Reference to up or down will be made for purposes of description with "up", "upper", or "upstream" meaning toward the earth's surface or toward the entrance of a well bore; and with "down", "lower", or "downstream" meaning toward the bottom of the well bore. In the drawings, the cross-sectional side views of the expandable anchor should be viewed from top to bottom, with the upstream end at the top of the drawing and the downstream end at the bottom of the drawing.

In the present specification, an embodiment showing a singular component should not be considered limiting. Rather, the subject matter preferably encompasses other embodiments including a plurality of the same component, and vice-versa, unless explicitly stated otherwise herein. Moreover, the applicant does not intend for any term in the specification or claims to be ascribed an uncommon or special meaning unless explicitly set forth as such. Further, the present subject matter encompasses present and future known equivalents to the known components referred to herein by way of illustration.

One or more embodiments of the disclosure are described below. It should be noted that these and any other embodiments are exemplary and are intended to be illustrative of the disclosure rather than limiting. While the disclosure is widely applicable to different types of systems, it is impossible to include all the possible embodiments and contexts of the disclosure in this disclosure. Upon reading this disclosure, many alternative embodiments of the present disclosure will be apparent to the person's ordinary skill in the art.

The benefits and advantages that may be provided by the present disclosure has been described above with regard to specific embodiments. These benefits and advantages, and any elements or limitations that may cause them to occur or to become more pronounced are not to be construed as critical, required, or essential features of any of any or all of the claims. As used herein, the singular forms "a," "an," and "the" are intended to include the plural forms as well, unless the context clearly indicates otherwise. It is further understood that the terms "comprises" and/or "comprising" or "includes" and/or including", or any other variation thereof, are intended to be interpreted as nonexclusively including the elements or limitations which follow those terms. Accordingly, a system, method, or other embodiment that comprises a set of elements is not limited to only those elements, and may include other elements not expressly listed or inherent to the claimed embodiment. These terms when used in this specification, specify the presence of stated features, regions, integers, steps, operations, elements, and/or components, but do not preclude the presence or addition of one or more features, regions, integers, steps, operations, elements, components, and/or groups thereof.

FIG. 1 depicts the bottom hole assembly (BHA) as it could be deployed in a wellbore departure operation, with this BHA including bypass valve 50, running tool 41, bi-mill 48, whipstock 42, hydraulic tubular 43, hinged connector 40 and dual-action hydraulically operable anchor 2 in an exterior isometric view, shown following actuation with the slips 4 having moved outward to protrude from the body of the anchor.

Figure 2:
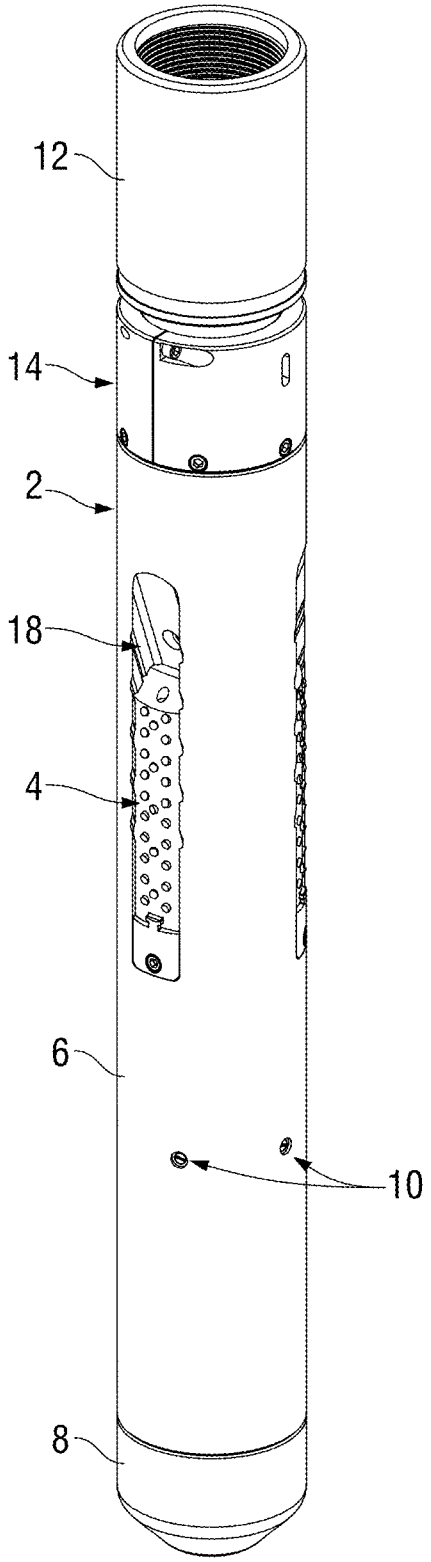
FIG. 2 depicts the dual-action hydraulically operable anchor in isometric view.

FIG. 2 depicts the dual-action hydraulically operable anchor 2 in isometric view, in its initial position with slips 4 not yet extended. The upper sub 12 is retained slidably with the anchor body 6 by the split clamps 14. The two split clamps 14 are held in place by screws (not shown) joining the two pieces together and by screws that externally pass through the lower circumference of the split clamps and thread into the anchor body 6. The slips 4 are depicted in their initial, unactuated position. The grooved pockets 18 in the anchor body 6 provide a guide along which the slips 4 can slide outward from the anchor body 6. The slips 4 have holes that contain cylindrical inserts (not shown) of a hard material that gain purchase on the wellbore wall, frictionally binding to it and slightly deforming it under extreme compressive force. Shear screw holes 10 receive shear screws (not shown) that hold the anchor body 6 and lower piston 22 in a fixed position until hydraulic force is applied, severing the screws connecting the anchor body 6 and lower piston 22 and enabling the lower piston 22 to travel upward. At the lower end of the hydraulic anchor 2, a threadably attached lower cap 8, with beveled leading edges, serves as a guide for anchor 2 and BHA during wellbore entry.

Figure 3:
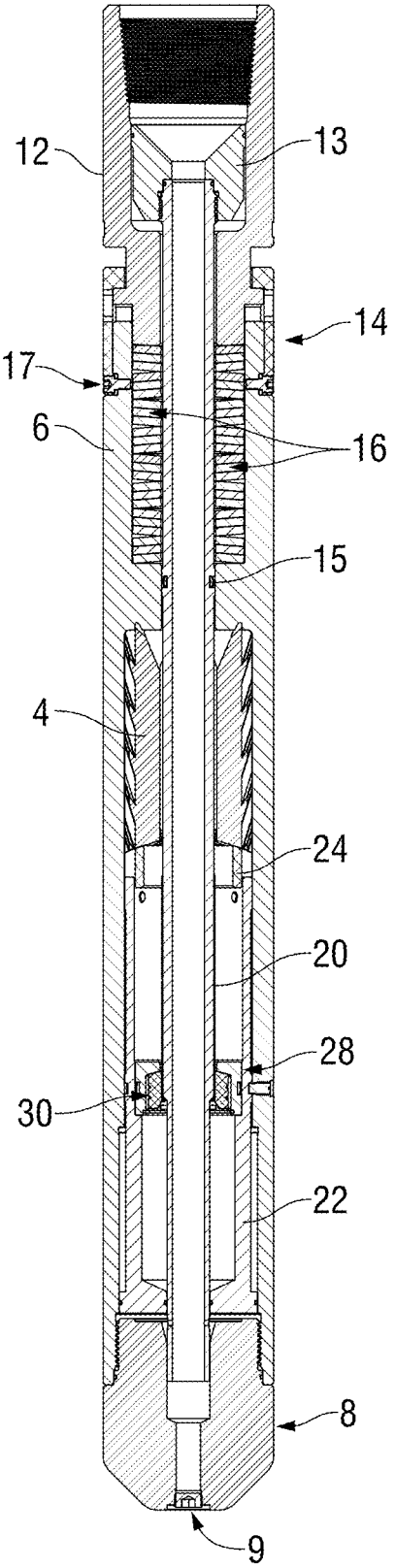
FIG. 3 depicts the dual-action hydraulically operable anchor in section view.

FIG. 3 depicts the dual-action hydraulically operable anchor 2 in section view and in its initial position with slips 4 not yet extended. The upper piston 13 is visible inside the upper sub 12, with upper piston 13 attached to the upper end of mandrel 20. Split clamps 14 are attached to anchor body 6 with screws (not shown) inserted in split clamp attachment holes 17, with split clamps 14 slidably retaining upper sub 12. The lower face of upper piston 13 is spaced slightly above a ledge face in upper sub 12. This gap remains fixed by shear screws 15 that connect the anchor body 6 to the mandrel 20. During hydraulic actuation of the anchor, and following actuation of lower piston 22 described below, the shear screws 15 will shear and permit downward travel of the floating mandrel 20 due to force exerted by upper piston 13. The Belleville spring stack 16 is shown applying compressive force to keep upper sub 12 and anchor body 6 separated in the initial, static position. Upper piston 13 travels against the Belleville spring force upon actuation. T-slot adapters 24 are shown at the bottom edge of the slips 4, where they are slidably attached to the slips. The inner portion of locking ratchet nut 28, which includes internal threaded nut segments 30, is circumferentially disposed around the floating mandrel 20. The locking ratchet nut 28 is also connected to the lower piston 22 with shear screws (not shown) spaced around its circumference. Initially connected, the lower piston 22 and locking ratchet nut 28 travel upward together after actuating hydraulic force is applied and some separate shear screws in shear screw holes 10 are severed, permitting releasing the lower piston 22 to travel. However, after the locking ratchet nut has locked into place along the floating mandrel 20 threads, and the slips 4 are fully extended, it may be necessary, under certain conditions, to remove the anchor from the wellbore. In order to remove the anchor, a rig at the surface applies tension to the workstring and thereby to the BHA and floating mandrel 20, and the shear screws connecting the locking ratchet nut 28 and lower piston 22 sever, permitting the lower piston 22 to retract to a lower position, the T-slot adapters 24 to retract, and the slips 4 along with them, permitting the removal of the hydraulic anchor 2 and BHA from the wellbore. Note that at the lower end of the hydraulic anchor 2, a threadably attached lower cap 8, with central bore and beveled leading edges, serves as a guide for the anchor and BHA during wellbore entry. Additionally, lower cap 8 is shown with lower cap plug 9 threadably inserted into the bottom of the central bore in lower cap 8. This lower cap plug 9 seals the hydraulic anchor 2 so that hydraulic force can be used to set the anchor. The lower cap plug 9 may be omitted so as to permit different functions, such as flow through the anchor with use of a dropped ball (not shown) in place lower cap plug 9 to seal the anchor 2 and permit hydraulic setting.

Hydraulic anchor 2, therefore, provides opposing upper and lower hydraulic pistons 13 and 22 for extending slips 4 outward with considerable force in order to fixedly position a whipstock 42 in a wellbore. Whipstock 42 enables wellbore exit milling and initial guiding of lateral drilling outside the wellbore. Hydraulic anchor 2 includes an upper sub 12 for loosely retaining a floating mandrel 20 attached to a hydraulic upper piston 13. Upper sub 12 houses hydraulic upper piston 13 to hydraulically engage and advance floating mandrel 20. Managing Member with supplied hydraulic force, advancing mandrel 20 downward.

Belleville spring stack 16 abuts the lower external face of upper sub 12, forcing upper sub 12 upward to the point where it is retained by the inner face of the upper portion of split clamp assembly 14 in the absence of hydraulic or mechanical compressive force. Upper sub 12 houses hydraulic upper piston 13, attached to the upper end of floating mandrel 20, is retained at the upper end of upper sub 12 by a threaded male connection end of a hinged connector or similar adjacent sub. Split clamp assembly 14 loosely and slidably retains upper sub 12 to hydraulic anchor body 6. Lower cap 5 fixedly couples to anchor body 6 and provides a guide nose for guiding the hydraulic anchor within the wellbore, smoothing its travel around minor obstructions or uneven portions of the wellbore, with lower cap 8 and hydraulic anchor body 6 threadably connected, and the lower cap 8 central bore being closed with a plug, or open, depending on operational parameters. Floating mandrel 20 extends from inside upper sub 12 to inside lower cap 5 with slidably moveable axial engagement of a locking ratchet nut 29 within hydraulic anchor body 6.

Inside floating mandrel 20, along its longitudinal axis, a flow of hydraulic fluid originating from a piston inside a running tool travels through floating mandrel 20 to actuate lower piston 22 disposed in anchor body 6, forcing the mandrel 20 upward and advancing the slips. Hydraulic lower piston 22 located below upper piston 13 at the end of floating mandrel 20 distal from upper piston 13 actuates from a first position to a second position along floating mandrel 20 using hydraulic fluid supplied through the inner axial bore of floating mandrel 20. Lower piston 22 actuation forces slips 4 outward from anchor body 6 and concurrently advances locking ratchet nut 28 along a threaded portion of floating mandrel 20. Additionally, floating mandrel 20 receives compressive force from the upper piston 13 housed in upper sub 12 when hydraulic force is applied to upper piston 12, forcing it downward against floating mandrel 20 and serving to advance mandrel 20 slidably against locking ratchet nut 28.

As needed, floating mandrel 20 can receive compressive force from mechanical force applied to the work string above and adjacent upstream BHA adjoining hydraulic anchor 2, providing yet more force to advance mandrel 20 slidably against locking ratchet nut 28. The two hydraulic forces and the mechanical force can be applied concurrently, making the forces additive, and thereby setting anchor 2 with extreme force. At the upper, uphole end of lower piston 22, T-slot adapter 24 engages mandrel 20 piston on the lower, downhole side of T-slot adapter 24. A slip slidably engages T-slot adapter 24 on the upper side of T-slot adapter 24 within the anchor housing. With standard-sized slips 4, slips 4 advance from a first flush-with-anchor housing 6 position through an opening in anchor housing 6 to a second, extended position extending outward from anchor housing 6 in response to movement of T-slot adapter 24 slidably engaged with the lower piston within anchor housing 6.

Figure 4:
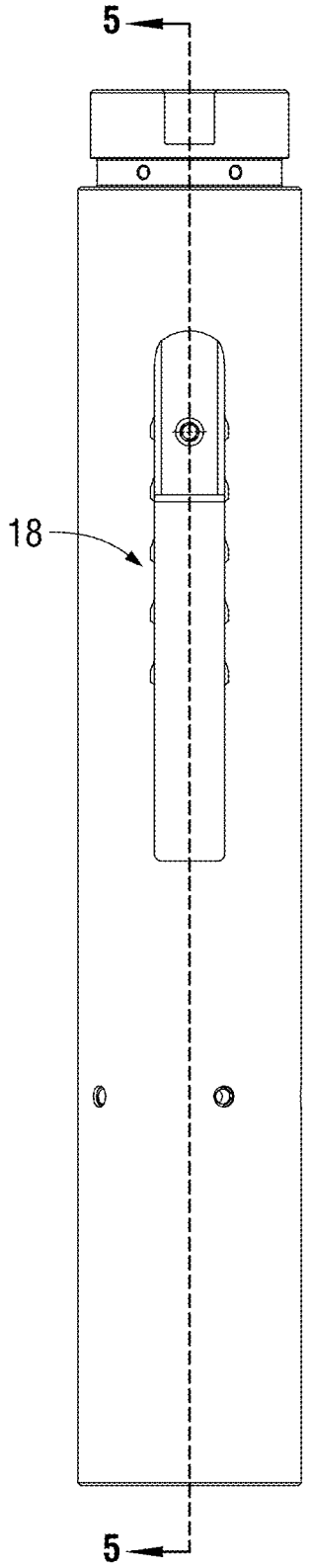
FIG. 4 depicts an isometric view of the exterior anchor body.
Figure 5:
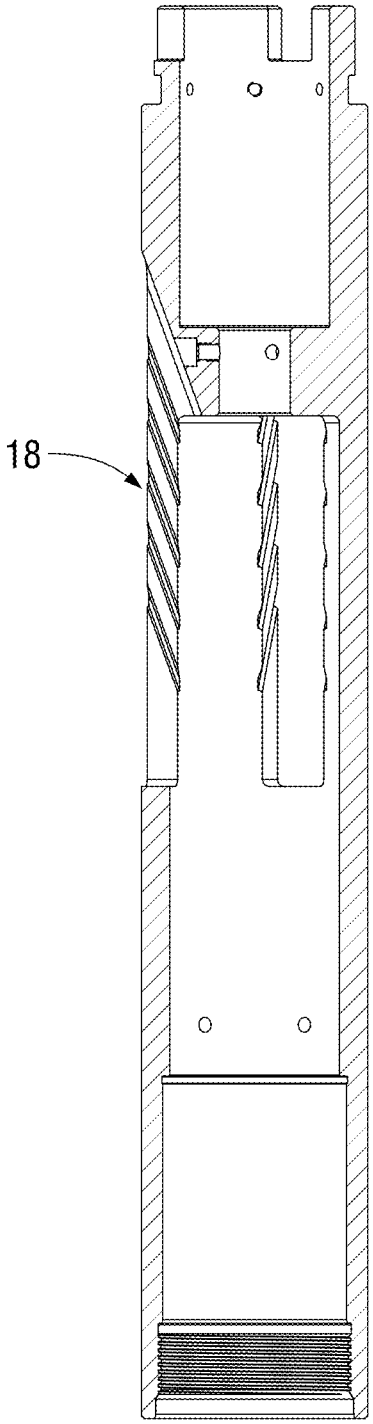
FIG. 5 presents a section view of the anchor body.

FIG. 4 depicts an isometric view of the exterior anchor body 6, with grooved pockets 18 for matching slips (not shown). FIG. 5 shows a section view of the anchor body 6, with grooved pockets 18 for matching slips (not shown).

Referring now to FIGS. 1 through 5, dual-action hydraulically actuated anchor 2 (hereinafter "hydraulic anchor") sets, or engages the wellbore wall, so as to fixedly lock in place, when hydraulically-actuated bypass valve 50 located uphole in the BHA receives sufficient flow and pressure to actuate, passing flow and pressure to a piston (not shown) inside a running tool 41. Running tool 41 may be located downhole from bypass valve 50 and uphole adjacent to bi-mill 48. The piston inside running tool 50 is actuated, sending a pressurized clean fluid through the bi-mill 48, through the lead mill 44, through a tubular item attached to the lead mill 44 continuing through a hydraulic tubular 43 conductor in the whipstock 42 and to upper piston 13 and lower piston 22 inside the anchor body 6, actuating the pistons.

Lower piston 22, inside anchor body 6, initially attaches to anchor body 6 by shear screws inserted through shear screw holes 10. When hydraulic power is applied and the lower piston 22 is actuated, it shears the shear screws in shear screw holes 10 and advances upward. The shear screws that fasten the lower piston 22 to the anchor body 6 serve to prevent accidental upward travel of the lower piston. Lower piston 22 drives T-slot adapters 24, slidably attached to the lower portions of slips 4 and fixedly attached to the upper portions of lower pistons 22, in an upward direction, with the T-slot adapter 24 forcing the slips outward from grooved pockets 18. The outward movement of the slips 4 is facilitated by the angle of the top of the grooved pocket 18 and the grooves themselves, as well as, on the lower end of the slips, the angle of the T-slot adapter 24.

As the lower piston 22 travels upward, a threaded locking ratchet nut 28 abuts a ledge inside the lower piston 22 to be secured to lower piston 22 by shear screws (not shown) spaced circumferentially around lower piston 22 and intersecting locking ratchet nut 28. The locking ratchet nut 28 is circumferentially grooved to accept shear screws and secures itself and lower piston 22 together in the initial, unactuated position, until hydraulic force is applied and the locking ratchet nut 28 and lower piston 22 advance upward together. As the locking ratchet nut 28 travels upward across a threaded portion of the floating mandrel 20, it locks in place on floating mandrel 20 and thereby mechanically locks T-slot adapters 24 and slips 4 in place.

Immediately following hydraulic actuation of the lower piston 22, upper piston 13 also actuates and travels a short distance in a downward, downhole direction. Upper piston 13 applies downward force to floating mandrel 20, in opposition to the force exerted by lower piston 22, forcing floating mandrel 20 against locking ratchet nut 28 from above at the same time as locking ratchet nut 28 is being forced upward by lower piston 22. This dual action ensures that slips 4 of hydraulic anchor 2 will be extended to maximum feasible distance and contact the wellbore wall with considerable force and mechanically lock into place. The mechanical lock provided by the locking ratchet nut 28 engagement with threads on floating mandrel 20 ensures that slips 4 remain in place, compressed against the wellbore wall with significant force, after the hydraulic anchor-setting operation has ceased.

Note that in this embodiment, at the lower end of hydraulic anchor 2, a threadably attached lower cap 8, with central bore and beveled leading edges, serves as a guide for the anchor and BHA during wellbore entry. Additionally, lower cap 8 is shown in FIG. 3 with lower cap plug 9 threadably inserted into the bottom of the central bore in lower cap 8. This lower cap plug 9 seals hydraulic anchor 2 so that hydraulic force can be used to set the anchor. Lower cap plug 9 may be omitted so as to permit different functions, such as flow through the anchor with use of a dropped ball (not shown) in place lower cap plug 9 to seal anchor 2 and permit hydraulic setting.

After hydraulic anchor 2 is set in place, whipstock 42 will resist significant compression, tension and torsion and remain fixed in the correct orientation for milling. At this point, the wellbore departure milling operation can begin.

An important feature of this embodiment is the shock absorbing aspects of the anchor body 6 and upper sub 12. This hydraulic anchor 2 has a stack of Belleville springs 16 that abut the lower end of its upper sub 12 and with the upper sub being attached to the BHA/workstring. Belleville springs 16 apply compressive force to keep the upper sub 12 and anchor body 6 spread apart under normal, static conditions, with the split clamps retaining the upper sub 12 and anchor body 6 together. The trip into the wellbore can produce unexpected difficulties. hydraulic anchor 2, the leading end of the BHA, can experience bumps and shocks along the way. If hydraulic anchor 2 experiences shocks as it travels downhole due to an uneven bore, debris, or other issues, the Belleville springs provide a cushioning effect that will help the anchor absorb shocks. On occasion, it may be necessary to utilize oversized slips in anchor 2 in order to accommodate a wellbore of larger inside diameter than the standard anchor slips are intended for. If such oversized slips were to be utilized, the slips and inserts could protrude from anchor body 6, even in the initial, unactuated position. In such a situation, the ability to absorb shocks can prevent damage to slips or inserts in the slips.

Hydraulic anchor 2 also makes use of three types of additive force in setting. The two opposing pistons 13 and 22 apply force in opposite directions, one pushing slips 4, via upward force on T-slot adapters 24, and the other pushing mandrel 20 downward, with both forces serving to advance locking ratchet nut 28 against mandrel 20 threads. These forces are applied concurrently following actuation. Yet a third force can be applied after the first two hydro-mechanical forces have been initialized and advanced slips 4 to gain initial pressure against the wellbore wall. The third force is mechanical force applied downward from the rig on surface through the workstring and BHA, reaching upper sub 12. Upper sub 12 may be used to mechanically force mandrel 20 downward after slips 4 have gotten the initial "bite" in the wellbore wall. This third force can be applied concurrently with the hydraulic force exerted by the opposing pistons 13 and 22, making these forces additive, and furthermore setting anchor slips 4 with extreme force. This feature is unprecedented in, unprecedented in prior art.

Figure 6:
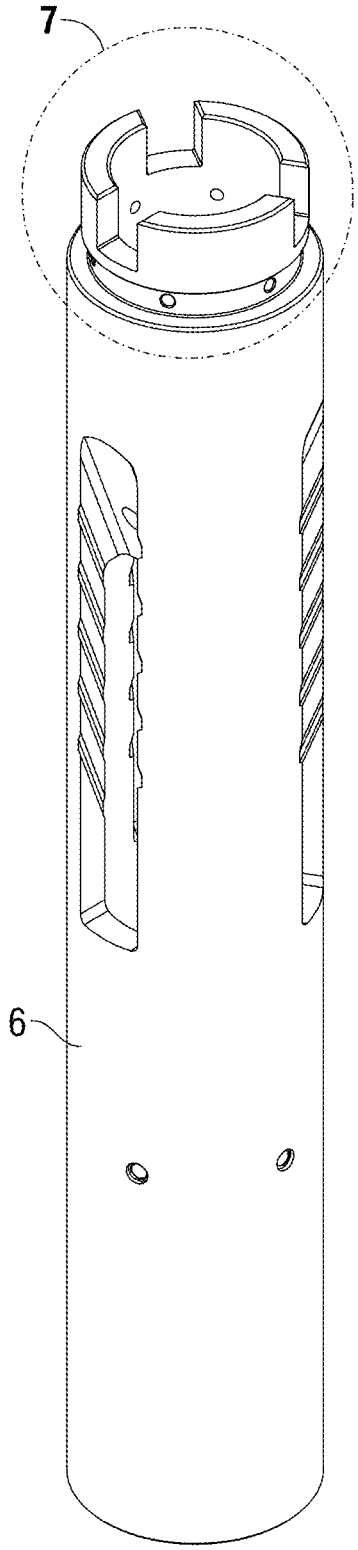
FIG. 6 highlights the castellated top portion of the anchor body.
Figure 7:
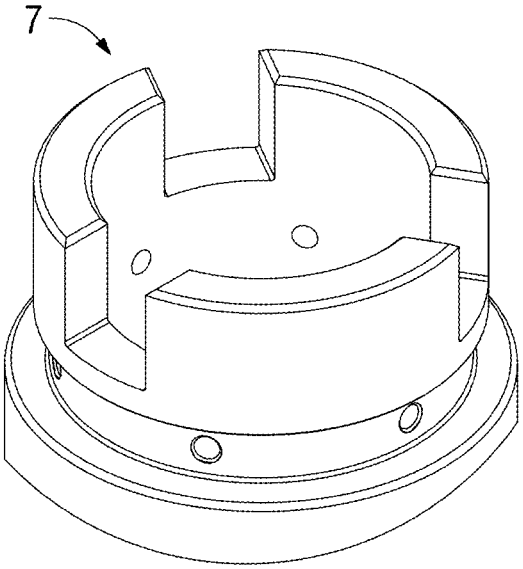
FIG. 7 shows this anchor body castellated top portion in detail.

FIG. 6 highlights the castellated top portion of the anchor body 6 and FIG. 7 shows anchor body 6 castellated top 7 portion in detail. Castellated top 7 matches a similar form at the bottom portion of upper sub 12 and allows smooth, slidable, torque resistant movement between anchor body 6 castellated top 7 and the matching castellated lower portion of upper sub 12.

Figure 8:
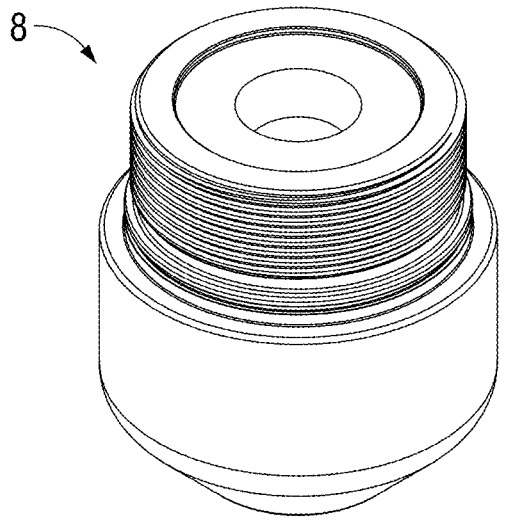
FIG. 8 shows an isometric view of the lower cap that attaches to the bottom of the anchor body.

FIG. 8 shows an isometric view of the lower cap 8 that threadably attaches to the bottom of the anchor body 6.

Figure 9:
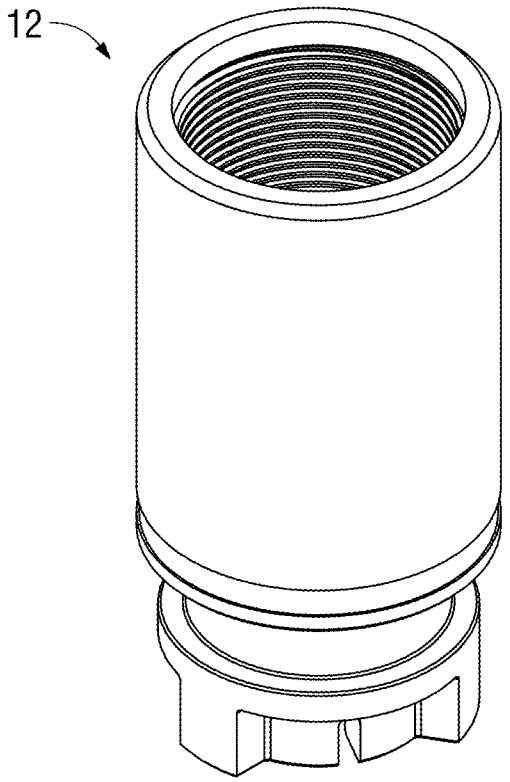
FIG. 9 shows the upper sub with castellated lower portion that fits snugly and slidably with anchor body castellated top.

FIG. 9 shows the upper sub 12 with castellated lower portion that fits snugly and slidably with anchor body castellated top 7.

Figure 10:
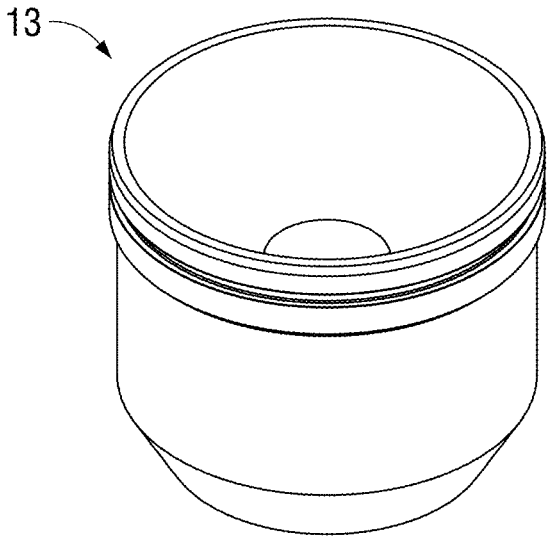
FIG. 10 shows the upper piston that fits inside an upper sub.

FIG. 10 shows the upper piston 13 that fits inside upper sub 12 and attaches threadably to the end of mandrel 20 as seen in FIG. 3, ultimately applying downward force to mandrel 20 when hydraulic actuation occurs.

Figure 11:
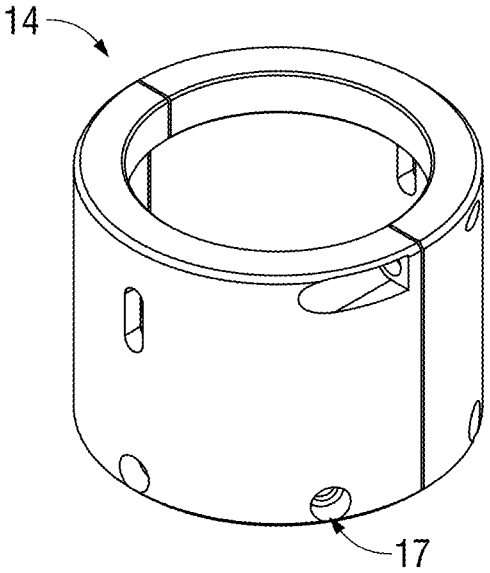
FIG. 11 shows two split clamps that fit over an upper sub and an anchor body.

FIG. 11 shows two split clamps 14 that fit over portions of upper sub 12 and anchor body 6 so as to retain them together. The split clamps 14 are connected together by two screws (not shown) at their upper end and also connected to the anchor body 6 as in FIG. 3 with screws (not shown) inserted into split clamp attachment holes 17 screws spaced around the circumference of the lower end of the split clamps 14 and threading into anchor body 6, while slidably retaining upper sub 12 as seen in FIG. 3.

Figure 12:
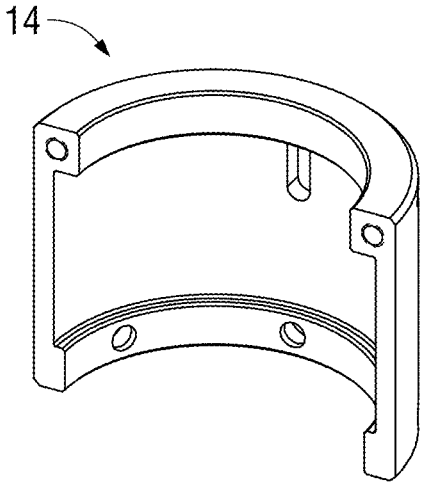
FIG. 12 depicts an isometric exterior view of a single split clamp.

FIG. 12 depicts an isometric exterior view of a single split clamp 14.

Figure 13C:
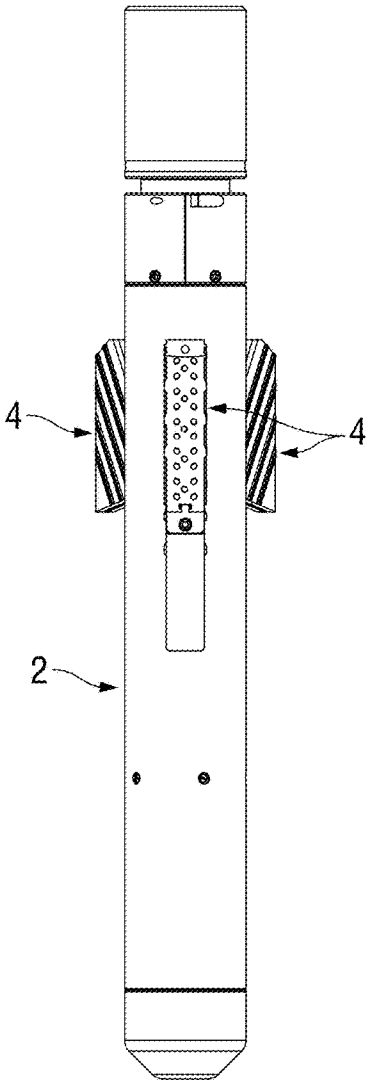
FIG. 13A through 13C shows operation of the dual-action hydraulically operable anchor.
Figure 13B:
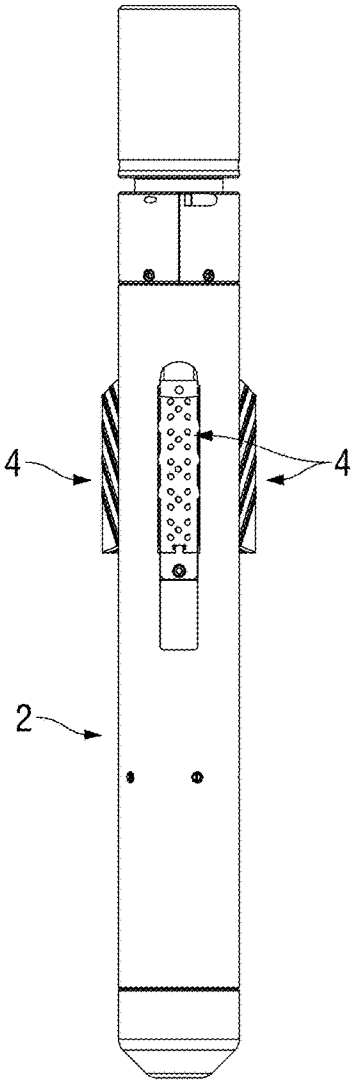
Figure 13A:
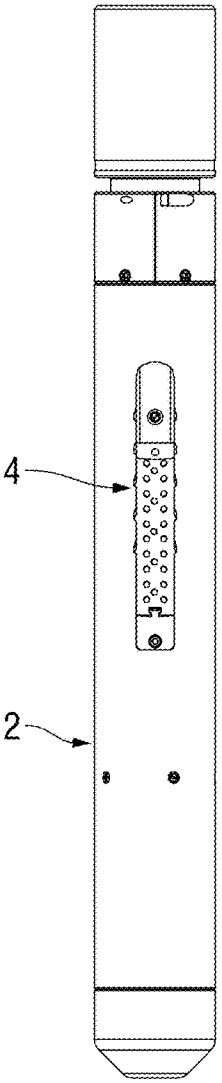

FIG. 13A shows the exterior of the dual-action hydraulically operable anchor 2 in its initial, unactuated position with slips 4 not extended from the anchor body 6.

FIG. 13B shows the exterior of the dual-action hydraulically operable anchor 2 in a partially actuated position with slips 4 partially extended from the anchor body 6.

FIG. 13C shows the exterior of the dual-action hydraulically operable anchor 2 in an actuated position with slips 4 fully extended outward from the anchor body 6.

Figure 14C:
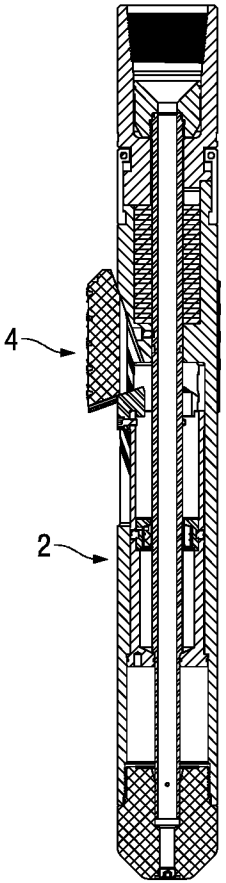
FIGS. 14A through 14C show a half section views of the various positions of a dual-action hydraulically operable anchor.
Figure 14B:
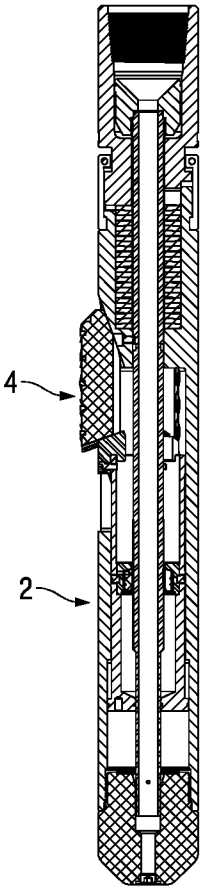
Figure 14A:
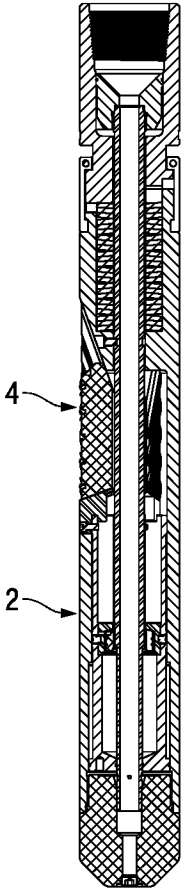

The effect of acute and obtuse angles on the outward movement of the slips 4 is clearly shown in FIGS. 14A, 14B, and 14C, where the initial position, partially actuated position, and actuated position of the slips 4 are depicted in stages. FIG. 14A shows a half-section view of the dual-action hydraulically operable anchor 2 in an unactuated position with slips 4 fully not extended from the anchor body 6. FIG. 14B shows a half section view of the dual-action hydraulically operable anchor 2 in a partially actuated position with slips 4 partially extended from the anchor body 6. FIG. 14C shows a half section view of the dual-action hydraulically operable anchor 2 in an actuated position with slips 4 fully extended outward from the anchor body 6.

Upon reaching its extended position, slips 4 firmly engage the wellbore to hold hydraulic anchor 2 and adjoining BHA components, including whipstock 42, in a fixed position. With the anchor fixedly secured against the wellbore casing or rock formation wall, a wellbore departure operation can be executed, subsequently providing a path for lateral drilling outside the main wellbore.

In summary, therefore, the present disclosure provides a dual-action hydraulically operable anchor 2 and methods of operation and manufacture for multilateral downhole drilling. The dual-action hydraulic anchor 2 includes hydraulic anchor body 6, and upper piston 13 and opposing lower piston 22. Upper piston 13 and lower piston 22 enable force slips 4 outward to fixedly position, or "set," the hydraulic anchor 2 in a wellbore. The hydraulic anchor 2, when set, secures the whipstock 42 and makes possible wellbore departure milling and guiding lateral drilling outside the wellbore.

The hydraulic anchor 2 further includes an upper sub 12 for slidably engaging and containing a floating mandrel 20, as well a hydraulic upper piston 13 that threadably attaches to the floating mandrel 20. floating mandrel 20A split clamp 14 flexibly retains the upper sub and fixedly attaches to the hydraulic anchor body 6. The split clamp 14 permits confined movement of the upper sub 12 toward and hydraulic anchor body 6 toward and away from each other. A lower cap 8 fixedly couples to the hydraulic anchor body 6 and includes a guide nose for guiding the hydraulic anchor 2 within the wellbore and containing a threaded plug 9 to hydraulically seal the the hydraulic anchor body 6.

A floating mandrel 20 within the hydraulic anchor body 6 includes an upper piston 13 threadably attached at the floating mandrel's 20 upper end and slidably moving within the upper sub 12 and along the longitudinal axis of the hydraulic anchor body 6. A hydraulic lower piston 22 with locking ratchet nut 28, upon anchor actuation, travels upward along the floating mandrel 20 and applies a first force to move slips 4 outward from the anchor body 6. Additionally, following the hydraulic lower piston's 22 upward travel, the hydraulic upper piston 13 applies compressive force to drive the floating mandrel 20 downward to advance in opposition to the movement of the hydraulic lower piston 22 and locking ratchet nut 28. Additionally further, the floating mandrel 20 transmits additional downward compressive force deriving from mechanical force applied from a surface rig to the workstring and BHA components uphole and adjoining the hydraulic anchor 2.

The hydraulic lower piston 22 is located below the hydraulic upper piston 13 and operates from a first position to a second position along the floating mandrel 20 using transmitted hydraulic fluid. A T-slot adapter 24 engages the hydraulic lower piston 22. A slip 4 engages the T-slot adapter 24 and may slide within the hydraulic anchor body 6 from a flush position along the hydraulic anchor body 6 to an extended position along the hydraulic anchor body 6 in response to movement of the T-slot adapter 24 and the lower piston 22 within the hydraulic anchor body 6. In response, the slip 4 firmly engages the wellbore to hold the hydraulic anchor 2 and the whipstock 42 in a fixed position within the wellbore, thereby providing a path for lateral drilling outside the wellbore. A threaded locking ratchet nut 28 attaches to the lower hydraulic piston 22 and slidably moves along a threaded portion of the floating mandrel 20. The locking ratchet nut 28 mechanically locks the lower hydraulic piston 22 in a second position, with the slips 4 being retained mechanically in the extended position engaging the wellbore wall.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein but is to be accorded the widest scope consistent with the principles and novel features disclosed herein. It is contemplated that additional embodiments are within the spirit and true scope of the disclosed subject matter.

What is claimed is:

1. A dual-action hydraulically operable anchor for wellbore exit milling, comprising:

a hydraulic anchor comprising a hydraulic anchor body, and an upper piston and an opposing lower piston, said upper piston and said lower piston for fixing an anchor in a wellbore to fixedly position whipstock in a wellbore, said whipstock for wellbore exit milling and for guiding lateral drilling outside the wellbore, said hydraulic anchor further comprising:

an upper sub for slidably engaging and housing a floating mandrel, said upper sub also housing said upper piston;

a split clamp flexibly retaining said upper sub and fixedly retaining said hydraulic anchor body with confined movement toward and away from said upper sub and hydraulic anchor body;

a lower cap fixedly coupled to said hydraulic anchor body and comprising a guide nose for guiding said hydraulic anchor within said wellbore, said lower cap and said hydraulic anchor body forming a fixed housing;

said floating mandrel comprising a mandrel with threadably attached upper piston and slidably moveable within said upper sub and said fixed housing and along the longitudinal axis of said fixed housing for transmitting a hydraulic fluid into said fixed housing or, alternatively, for transmitting compressive force from said upper piston, or alternatively, for transmitting compressive force deriving from mechanical force applied to a work string and an adjoining bottom hole assembly above and adjoining the hydraulic anchor;

said lower piston located below said upper piston and operable from a first position to a second position along said floating mandrel using said transmitted hydraulic fluid;

a T-slot adapter engaging said lower piston;

a slip engaging said T-slot adapter and slidable within said fixed housing from a flush position along said fixed housing to an extended position along said fixed housing in response to movement of said T-slot adapter and said lower piston within said fixed housing, such that said slip firmly engages the wellbore to hold said hydraulic anchor and said whipstock in a fixed position within the wellbore, thereby providing a path for lateral drilling outside the wellbore: and a threaded ratchet nut attached to said lower piston and slidably moveable along a threaded portion of the floating mandrel, said threaded ratchet nut mechanically locking said lower piston in a second position, with said slips being retained mechanically in the extended position engaging the wellbore wall.

2. The hydraulic anchor of claim 1, further comprising a Belleville spring assembly for keeping said upper sub and said anchor body spread apart under ambient, static conditions, wherein said split clamps retain said upper sub and said anchor body together.

3. The hydraulic anchor of claim 2, wherein said Belleville spring assembly provides a cushioning effect for aiding in helping said anchor body to absorb shocks as said anchor moves within the wellbore prior to setting.

4. The hydraulic anchor of claim 1, further comprising a castellated top portion matching a similar form at the bottom portion of upper sub and for allowing smooth, slidable, torque resistant movement between said anchor body and said bottom portion of said upper sub.

5. The hydraulic anchor of claim 1, wherein actuation of said lower piston forces said slips outward from said anchor body and concurrently advances said locking ratchet nut along a threaded portion of said floating mandrel.

6. The hydraulic anchor of claim 1, wherein said upper piston and said lower piston apply forces in opposite directions for pushing said slips outward from said anchor body using said upper piston and pushing said floating mandrel downward and using said lower piston to advance said slidably attached T-slot adapter upward advancing slidably attached slips outward.

7. The hydraulic anchor of claim 6, wherein said slips moving outward from said anchor body cause said slips to contact and engage the wellbore wall once the hydraulic anchor reaches a desired depth and circumferential orientation.

8. A method for operating a dual-action hydraulically operable anchor for wellbore exit milling, comprising the steps of:

providing a hydraulic anchor comprising a hydraulic anchor body, and an upper piston and an opposing lower piston, said upper piston and said lower piston for fixing an anchor in a wellbore to fixedly position a whipstock in a wellbore, said whipstock for wellbore exit milling and for guiding lateral drilling outside the wellbore, said hydraulic anchor further comprising:

engaging and housing a floating mandrel within an upper sub, said upper sub also housing said upper piston;

flexibly retaining said upper sub and said hydraulic anchor body using a split clamp to provide confined movement toward and away from said upper sub and hydraulic anchor body;

guiding said hydraulic anchor within said wellbore using a lower cap fixedly coupled to said hydraulic anchor body and a guide nose, forming a fixed housing comprising said lower cap and said hydraulic anchor body;

providing said floating mandrel comprising a mandrel with a threadably attached lower piston slidably moveable within said upper sub and fixed housing and along the longitudinal axis of said fixed housing or, alternatively, for transmitting compressive force from said lower piston using said floating mandrel, or alternatively, for transmitting compressive force deriving from mechanical force applied to the a workstring adjoining a bottom hole assembly adjoining said hydraulic anchor using said floating mandrel;

operating said lower piston located below said upper piston from a first position to a second position along said floating mandrel using said transmitted hydraulic fluid;

engaging said lower piston using a T-slot adapter;

engaging said T-slot adapter within said fixed housing from a flush position along said fixed housing to an extended position along said fixed housing in response to movement of said T-slot adapter and said lower piston within said fixed housing using a slip for slidably, such that said slip firmly engages the wellbore to hold said hydraulic anchor and said whipstock in a fixed position within the wellbore, thereby providing a path for lateral drilling outside the wellbore; and slidably and movably attaching a threaded ratchet nut to said lower piston along a threaded portion of the floating mandrel, and mechanically locking said lower hydraulic piston in a second position with said threaded ratchet nut, said slips being retained mechanically in the extended position engaging the wellbore wall.

9. The method of claim 8, further comprising the steps of keeping said upper sub and said anchor body spread apart under ambient, static conditions using a Belleville spring assembly, and further retaining said upper sub and said anchor body together using said split clamps.

10. The method of claim 9, further comprising the step of providing a cushioning effect for aiding in helping said anchor body to absorb shocks as said anchor moves within the wellbore prior to setting using said Belleville spring assembly.

11. The method of claim 8, further comprising the step using a castellated top portion matching a similar form at the bottom portion of upper sub for allowing smooth, slidable, torque resistant movement between said anchor body and said bottom portion of said upper sub.

12. The method of claim 8, further comprising the step of actuating said lower piston for forcing said slips outward from said anchor body and concurrently advances said locking ratchet nut along a threaded portion of said floating mandrel.

13. The method of claim 8, further comprising the step of moving said upper piston and said lower piston for applying forces in opposite directions for pushing said slips outward from said anchor body using said lower piston and pushing said floating mandrel downward using said upper piston.

14. The method of claim 13, further comprising the step of moving said slips outward from said anchor body for causing said slips to contact and engage the wellbore wall once the hydraulic anchor reaches a desired depth and circumferential orientation.

15. A method for manufacturing a dual-action hydraulically operable anchor for multilateral downhole drilling, comprising the steps of:

making a hydraulic anchor comprising a hydraulic anchor body, and an upper piston and an opposing lower piston, said upper piston and said lower piston for fixing an anchor in a wellbore to fixedly position whipstock in a wellbore, said whipstock for wellbore exit milling and for guiding lateral drilling outside the wellbore, said hydraulic anchor further comprising:

making an upper sub for slidably engaging and housing a floating mandrel, said upper sub also housing said upper piston;

making a split clamp flexibly retaining said upper sub and fixedly retaining said hydraulic anchor body with confined movement toward and away from said upper sub and hydraulic anchor body;

making a lower cap fixedly coupled to said hydraulic anchor body and comprising a guide nose for guiding said hydraulic anchor within said wellbore, said lower cap and said hydraulic anchor body forming a fixed housing;

making said floating mandrel comprising a mandrel with threadably attached upper piston and slidably moveable within said upper sub and said fixed housing and along the longitudinal axis of said fixed housing for transmitting a hydraulic fluid into said fixed housing or, alternatively, for transmitting compressive force from said lower piston, or alternatively, for transmitting compressive force deriving from mechanical force applied to the a work string and an adjoining bottom-hole assembly above and adjoining the hydraulic anchor;

forming said lower piston to be located below said upper piston and operable from a first position to a second position along said floating mandrel using said transmitted hydraulic fluid;

making a T-slot adapter engaging said lower piston;

making a slip engaging said T-slot adapter and slidable within said fixed housing from a flush position along said fixed housing to an extended position along said fixed housing in response to movement of said T-slot adapter and said lower piston within said fixed housing, such that said slip firmly engages the wellbore to hold said hydraulic anchor and said whipstock in a fixed position within the wellbore, thereby providing a path for lateral drilling outside the wellbore: and making a threaded ratchet nut attached to said lower piston and slidably moveable along a threaded portion of the floating mandrel, said threaded ratchet nut mechanically locking said lower piston in a second position, with said slips being retained mechanically in the extended position engaging the wellbore wall.

16. The hydraulic anchor manufacturing method of claim 15, further comprising the step of making a Belleville spring assembly for keeping said upper sub and said anchor body spread apart under ambient static conditions, wherein said split clamps retain said upper sub and said anchor body together.

17. The hydraulic anchor manufacturing method of claim 16, further comprising the step of making said Belleville spring assembly for providing a cushioning effect for aiding in helping said anchor body to absorb shocks as said anchor moves within the wellbore prior to setting.

18. The hydraulic anchor manufacturing method of claim 15, further comprising the step of making a castellated top portion matching a similar form at the bottom portion of upper sub and for allowing smooth, slidable, torque resistant movement between said anchor body and said bottom portion of said upper sub.

19. The hydraulic anchor manufacturing method of claim 15, further comprising the step of making actuation of said lower piston forces said slips outward from said anchor body and concurrently advances said locking ratchet nut along a threaded portion of said floating mandrel.

20. The hydraulic anchor manufacturing method of claim 15, further comprising the step of applying moving forces in opposite directions through said upper piston and said lower piston for pushing said slips outward from said anchor body using said lower piston and pushing said floating mandrel downward using said upper piston.

* * * * *